US011994288B2

(12) United States Patent
Champagne

(10) Patent No.: US 11,994,288 B2
(45) Date of Patent: May 28, 2024

(54) PORTABLE LIQUID FUEL VAPORIZER

(71) Applicant: Eric Champagne, Windsor (CA)

(72) Inventor: Eric Champagne, Windsor (CA)

( * ) Notice: Subject to any disclaimer, the term of this patent is extended or adjusted under 35 U.S.C. 154(b) by 356 days.

(21) Appl. No.: 17/081,934

(22) Filed: Oct. 27, 2020

(65) Prior Publication Data

US 2021/0041103 A1 Feb. 11, 2021

(51) Int. Cl.

| | |
|---|---|
| ***F23K 5/22*** | (2006.01) |
| ***F23K 5/20*** | (2006.01) |
| ***F28D 9/00*** | (2006.01) |
| *F28D 1/02* | (2006.01) |
| *F28D 1/047* | (2006.01) |
| *F28D 21/00* | (2006.01) |
| *F28F 9/00* | (2006.01) |

(52) U.S. Cl.

CPC ..... *F23K 5/22* (2013.01); *F23K 5/20* (2013.01); *F28D 9/005* (2013.01); *F23K 2300/205* (2020.05); *F28D 1/0213* (2013.01); *F28D 1/047* (2013.01); *F28D 1/0472* (2013.01); *F28D 21/0003* (2013.01); *F28D 2021/0024* (2013.01); *F28D 2021/0064* (2013.01); *F28F 9/005* (2013.01); *F28F 2235/00* (2013.01)

(58) Field of Classification Search

CPC ..... F23K 5/20; F23K 5/22; F23K 2300/205; F28D 1/0213; F28D 1/047; F28D 1/0472; F28D 9/005; F28D 21/0003; F28D 2021/0024; F28D 2021/0064; F28F 9/005; F28F 2235/00

USPC ..... 122/10

See application file for complete search history.

(56) References Cited

U.S. PATENT DOCUMENTS 2,354,932 A * 8/1944 Walker ..... B01B 1/00 126/360.1
2,582,134 A * 1/1952 Kimmell ..... F24H 1/145 165/104.19

(Continued)

FOREIGN PATENT DOCUMENTS

CA 2791305 A1 * 4/2014 ..... F23K 5/22
CN 207641009 U * 7/2018
KR 200177157 Y1 * 4/2000

OTHER PUBLICATIONS

CN 207641009 U—Translation (Year: 2018).*
KR 200177157 Y1—Translation (Year: 2000).*

*Primary Examiner* — Steven B McAllister
*Assistant Examiner* — Benjamin W Johnson

(57) ABSTRACT

A vaporizer for heating a liquid phase fuel, the vaporizer comprising a reservoir having a least one wall for containing a liquid and a heat-conducting fluid within the reservoir. A heating core extending into the reservoir such that the heating core is in fluid contact with the heat-conducting fluid and the heating core has an inlet through which the liquid phase fuel will flow and an outlet through which the vaporized liquid phase fuel will flow. A heating passage having at least one open end extending at least partially within the reservoir such that at least a portion of an exterior surface of the heating passage is in fluid contact with the heat-conducting fluid. A heat source communicating with the open end of the heating passage to heat the heating passage, which in turn heats the heat conducting fluid and the liquid phase fuel within the heating core to vaporize the liquid phase fuel.

20 Claims, 8 Drawing Sheets

(56) References Cited

U.S. PATENT DOCUMENTS

| | | | | | |
|---|---|---|---|---|---|
| 3,603,101 | A * | 9/1971 | Sullivan | F17C 7/00 | 122/15.1 |
| 3,712,073 | A * | 1/1973 | Arenson | F17C 9/02 | 165/104.21 |
| 3,724,426 | A * | 4/1973 | Brown | F23K 5/22 | 62/50.2 |
| 3,986,340 | A * | 10/1976 | Bivins, Jr. | F28D 15/02 | 165/104.27 |
| 4,117,806 | A * | 10/1978 | Manning | F28F 13/06 | 165/104.19 |
| 4,131,084 | A * | 12/1978 | Hanson | F17C 7/04 | 62/50.4 |
| 4,203,300 | A * | 5/1980 | Hanson | B01D 1/00 | 165/104.32 |
| 4,326,492 | A * | 4/1982 | Leibrand, Sr. | F02M 31/16 | 165/104.19 |
| 5,921,206 | A * | 7/1999 | Sams | F24H 1/28 | 122/367.1 |
| 2007/0000453 | A1* | 1/2007 | King | F28D 1/0213 | 165/104.19 |
| 2011/0017720 | A1* | 1/2011 | Tsung | H05B 1/0227 | 219/510 |
| 2013/0334797 | A1* | 12/2013 | Umbro | B62B 1/264 | 280/654 |
| 2015/0330627 | A1* | 11/2015 | Neufeldt | F23K 5/20 | 431/11 |

* cited by examiner

PORTABLE LIQUID FUEL VAPORIZER

TECHNICAL FIELD

The present invention relates to vaporizing liquid-phase fuels. In particular, the present invention relates to vaporizing liquid propane to gaseous propane to be used in a portable torch especially during cold temperatures.

BACKGROUND

Many gas-operated tools require an ample amount of gas under a certain pressure to function properly. One such tool is a portable propane torch used to produce a flame at the end of the torch and apply heat to a surface. The necessary pressure required will be determined by the heat output requirements of the torch for a specified use.

The pressure of the gaseous propane within a tank is a function of the ambient temperature surrounding the tank. Therefore, when the ambient temperature drops below a certain temperature, the pressure of the gas within the tank will be insufficient to provide the torch with the necessary amount of gas to produce the necessary heat.

Using liquid propane can reduce the inconveniences of using gaseous propane because liquid propane vaporizes at approximately −45 Fahrenheit whereas gaseous propane at −45 Fahrenheit will provide little pressure. Conventional liquid vaporizers are meant to be stationary and are not adapted to be portable or used over a large range of ambient temperatures.

Therefore, there is a need for a portable device which can vaporize liquid-phase fuels to be used under ambient conditions.

SUMMARY OF THE INVENTION

One object of the present is to ameliorate at least some of the inconveniences of the prior art.

One aspect of the present invention provides a vaporizer for heating a liquid phase fuel, the vaporizer comprising a reservoir having a least one wall fox containing a liquid; a heat-conducting fluid within the reservoir; a heating core extending into the reservoir such that the heating core is in fluid contact with the heat-conducting fluid, the heating core having an inlet through which the liquid phase fuel will flow and an outlet through which the vaporized liquid phase fuel will flow; a heating passage having at least one open end, the heating passage extending at least partially within the reservoir such that at least a portion of an exterior surface of the heating passage is in fluid contact with the heat-conducting fluid; a heat source, the heat source communicating with the open end of the heating passage to heat the heating passage, the heat conducting fluid and the liquid phase fuel within the heating core to vaporize the liquid phase fuel within the heating core.

In some implementations, the heating passage further comprises a thin-walled hollow tube.

In some implementations, the heat source is a burner producing a flame, wherein the flame is directed into the heating passage.

In some implementations, the heating passage further comprises a first end having a first opening, the flame being directed into the first opening of the heating passage.

In some implementations, the burner is placed adjacent the first opening of the heating passage such that the flame is completely surrounded by heating passage.

In some implementations, the heating passage further comprises a second end having a second opening, the second opening passing through the reservoir such that exhaust created by the flame is exhaust to the atmosphere.

In some implementations, the heating core further comprises a thin-walled tube, the first end fluidly connected to a liquid-phase fuel source and the second end fluidly connected to a utility tool.

In some implementations, wherein the thin-walled tube of the heating core extends into the reservoir in the shape of a spiral.

In some implementations, the heating core further comprises a flange connected to the reservoir, the first and second ends of the heating core connected to the flange such that the liquid-phase fuel passes through the flange into the heating core.

In some implementations, the heating core flange further comprises an aperture through which the heat-conducting fluid is poured into the reservoir.

In some implementations, the vaporizer further comprises a first hose, the first hose having a first end fluidly connected to the second end of the heating core and a second end connected to the burner.

In some implementations, the vaporizer further comprises a second hose, the second hose having a first end connected to the second end of the heating core and a second end connected to the utility tool.

In some implementations, the vaporizer further comprises a splitter, the splitter having at least one inlet and at least two outlets, the at least one inlet fluidly connected to the second end of the heating core and a first one of the at least two outlets fluidly connected to the burner and a second one of the at least two outlets connected to the utility tool.

In some implementations, the splitter further comprised a third outlet, the third outlet fluidly connected to a second utility tool.

In some implementations, the heating core is removably fixed to the reservoir.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Although the present technology is described below with respect to a utility torch using a portable liquid propane vaporizer it is contemplated that aspects of the present technology could be applied to vaporize other natural gases to supply other tools including, but not limited to boilers and grills.

Figure 1:
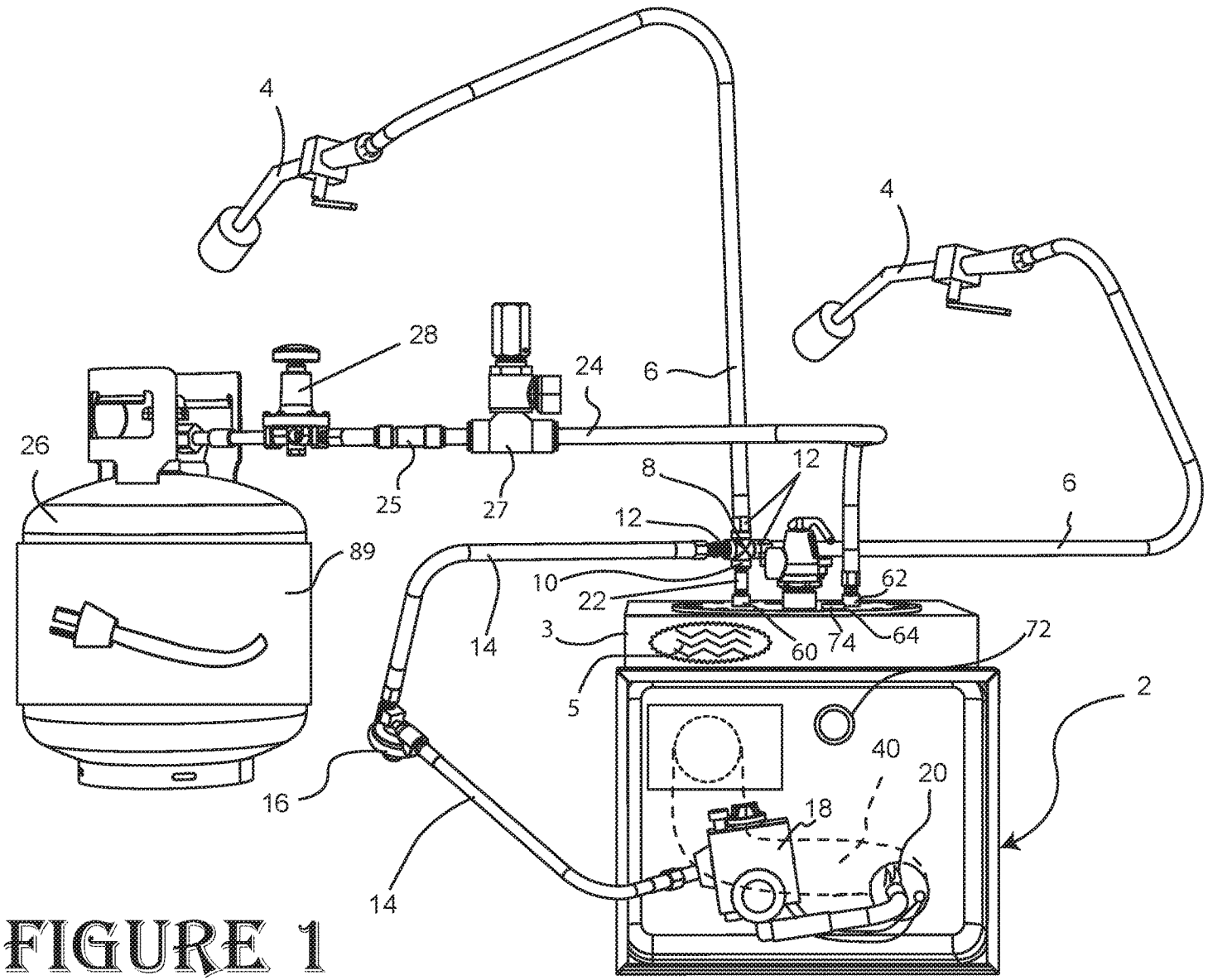
FIG. 1 is a front plan view of the vaporizer of the present implementation.

With reference to FIG. 1, a vaporizer 2 is connected to one or more tools such as utility torches 4 via hoses 6. A splitter 8, having one or more inlets 10 and one or more outlets 12, distributes the gas from the vaporizer 2 to the utility torches 4 and connects to vaporizer 2 via hose 22. It is contemplated that splitter 8 could be replaced with multiple hoses receiving gas directly from vaporizer 2.

Hose 14 connects splitter 8 to a burner 18 to provide burner 18 with gas to produce a flame 20 which will be described in more detail below.

To provide burner 18 with the gas under the necessary pressure, a regulator 16 is provided between the splitter 8 and the burner 18. In the present implementation, regulator 16 will regulate the flow of gas to 0.5 PSI (pounds per square inch) to the burner 18.

To supply liquid-phase fuel to vaporizer 2, a tank 26 of the liquid-phase fuel is connected to the vaporizer 2 via hose 24. A regulator 28 regulates the pressure of the liquid-phase fuel from the tank 26 to obtain the desired pressure for which the vaporizer 2 is designed. In the present implementation, regulator 28 will regulate the pressure between 40 PSI to 100 PSI to correspond to the operating pressures of the utility torches 4. To prevent any reverse flow of liquid or gaseous phase fuel toward the tank 26, a one-way valve or check valve 25 can be added to the hose 24. Such a valve can be obtained from RegO® Product Manufacturing. Valve 25 could be placed upstream or downstream of the regulator 28. Downstream from valve 25 is a security valve 27. Security valve 27 ensures that the pressure or the flow amount of the liquid-phase fuel within the hose 24 does not exceed a predetermined value. The predetermined value could be a function of one of the components of the vaporizer 2 such as hoses 6, 14 or 24 or reservoir 30 for example. In the present implementation, security valve 27 is set to limit the amount of liquid-phase fuel through the security valve to approximately 25 GPM (gallons per minute) but other limitations are contemplated. It is also contemplated that valve 27 could be used to open and expel liquid or gaseous fuel within the hose 24 to the atmosphere when the pressure reaches approximately 350 PSI, but other limits are contemplated. It is further contemplated that the order of the regulator 28, check valve 25 and security valve 27 along hose 14 could be other than that shown in FIGS. 1 and 2.

Figure 2:
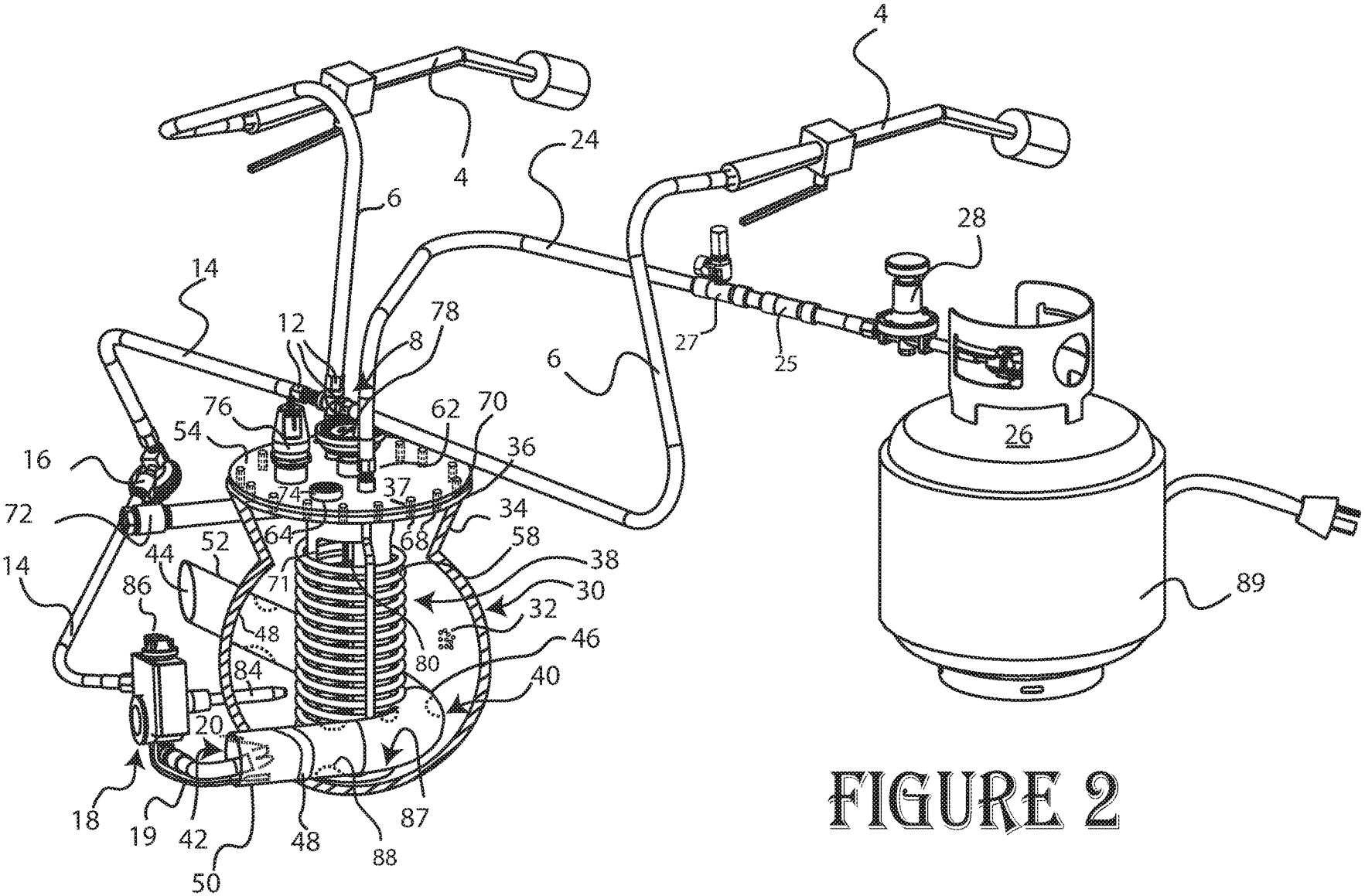
FIG. 2 is an isometric view of various components of the vaporizer of the present implementation where several components of the vaporizer have been removed for clarity.

With reference to FIG. 2, protective housing 3 and insulating material 5 surrounding reservoir 30, both shown in FIG. 1, have been removed for clarity. Vaporizer 2 includes reservoir 30 for containing a heat conducting fluid or the like. In the present implementation, reservoir 30 has a spherical base portion 33 with a cylindrical upper portion 34. Cylindrical upper portion 34 further includes a flange 36 used to seal reservoir 30 with heating core 38 described in more detail below. It is contemplated that reservoir 30 could be any suitable shape.

Reservoir 30 is filled with a fluid such as water or a water and propylene glycol mixture. It is contemplated that any material suitable for transferring heat could be used such as liquids, gels, fibers and the like. In the present implementation, reservoir 30 is filled with 50-50 mixture of water and propylene glycol which is suitable for using the vaporizer in ambient temperatures below the freezing temperature of water.

Passing through and within reservoir 30 is a heating passage 40. Heating passage 40 has a first opening or inlet 42 and a second opening or outlet 44. Between first and second openings 42 and 44, heating passage 40 extends inside the reservoir 30 such that a surface 46 of the heating passage 40 is in contact with the water-glycol mixture 32 or its equivalent.

In the present implementation, heating passage 40 is a metallic u-shaped thin-walled tube inserted into reservoir 30 such that first end 50 and second end 52 of the heating passage 40 pass through openings 48 in the reservoir 30 and can be surrounded by the water-glycol mixture 32 within the reservoir 30. To prevent any liquid from leaking between reservoir 30 and heating passage 40, heating passage 40 is sealed to reservoir 30 by welding or any suitable manner. Where a solid material is used for the heat transfer material, it is contemplated that reservoir 30 and heating passage 40 may not need to be sealed together.

While the present implementation uses a heating passage 40 inserted within reservoir 30, it is contemplated that heating passage 40 could be integrally made via extensions of, or integral with, the wall(s) of the reservoir 30. It is also contemplated that heating passage 40 could have ends that extend outside the reservoir 30 or be flush with the walls of the reservoir 30.

Placed near the first opening 42 of the heating passage 40 is the burner 18 used to create a flame 20. A pilot flame 19 is placed near the burner 18 which serves as an ignition source for burner 18. Pilot flame 19 can be kept permanently alight to ignite burner 18 whenever the gas source through hose 14 is opened. Flame 20 is directed into the heating passage 40 and generates heat which flows through heating passage 40 which in turn heats the walls of heating passage 40. As mentioned above, heating passage 40 is constructed of metal such as carbon steel, stainless steel or aluminum which will allow an efficient heat transfer into the water-glycol liquid or other heating material. Introducing heat directly into the reservoir 30 through the heating passage 40 increases the efficiency of the heat transfer to the water-glycol mixture 32 surrounding the heating passage 40 which maintains the temperature of the water-glycol mixture 32 at the desired temperature using the minimum amount of gas for the burner 18. The present implementation also has flame 20 within the heating passage 40 and as such is not in contact with the exterior surface of the reservoir 30 thus there is no open flame as is found in many conventional vaporizers. Burner 18 is oriented such that flame 20 shoots into heating passage 40 and heating passage 40 substantially completely surrounds flame 20 and a portion of the burner 18 in a radial direction of the heating passage 40.

Because of the portable nature of the present implementation, it is beneficial that no open flame is exposed to the surrounding components such as tank 26 if placed near vaporizer 2. The exterior surface 46 of the heating passage 40 creates a very large contact area for the water-glycol mixture 32 to receive heat from a single concentrated burner creating a very efficient and safe heat transfer system.

Although the present implementation illustrates a u-shaped heat passage 40, it is contemplated that heating passage 40 could be of any size and shape. It is further contemplated that heating passage 40 could have a spiral shape such as that of the heating core 38, to increase its surface area in contact with the water-glycol mixture to further enhance the heat transfer and ensure a maximum use of the heat generated by the burner 18. It is also contemplated that the cross section between inlet 42 and outlet 44 could vary.

Exhaust such as carbon monoxide created by burner 18 are expelled to the atmosphere through second opening 44.

To further increase the efficiency of the heating passage 40, it is contemplated that interior surface 87 of heating passage 40 could include protrusions 88 which effectively increase the surface area of the heating passage 40 and thus increase the heat transfer between the heat generated by burner 18 and the water-glycol mixture 32.

To further increase the efficiency of the vaporizer 2 when used in ambient temperatures near or below freezing, the reservoir 30 is surrounded by the insulation material 5 such as a fireproof insulation from Rockwool®. Insulating material 5 is held in place between the protective housing 3 and the reservoir 30. Protective housing 3 of the present implementation is constructed of aluminum to prevent against corrosion because the vaporizer 2 will be used outside thus exposed to many different forms of precipitation during its use. Because of the portability of vaporizer 2, protective housing 3 also serves to protect the internal components of vaporizer 2.

Burner 18 receives gas from splitter 8 through hose 14. To reduce the pressure of the gas received at burner 18, a regulator 16 is placed along hose 14 which reduces the pressure of the gas to a suitable pressure for burner 18, which, in the present implementation is approximately 0.5 psi.

Figure 8:
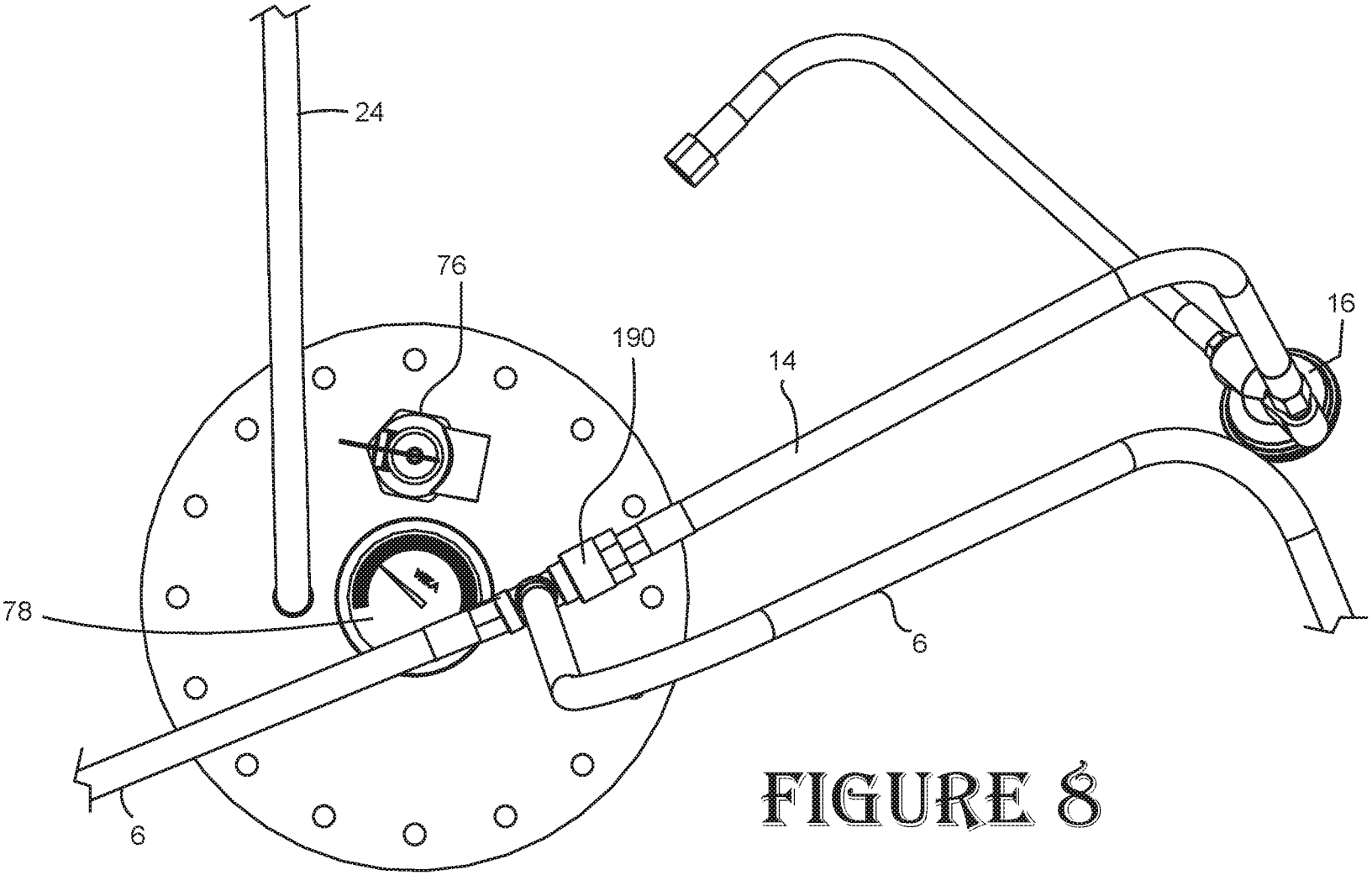
FIG. 8 is a top plan view of the heating core and hoses including a check valve and reducer of a third implementation.

While the present implementation illustrates burner 18 receiving gas from tank 26 including a liquid-phase fuel which will be vaporized through vaporizer 2, it is contemplated that a separate tank of gaseous fuel could be connected directly to burner 18 and pilot flame 19. With reference to FIG. 8, it is also contemplated that a reducer 190 could be placed between the vaporizer 2 and the burner 18. Reducer 190 creates a section of reduced diameter flowing into the hose 14 which will help any liquid-phase fuel exiting vaporizer 2 via splitter 8 to vaporize, if not already done so, before flowing through the regulator 16. Introducing liquid-phase fuel instead of gaseous fuel to regulator 16 may cause the regulator to not function as intended as regulator 16 is intended to regulate a gas. When not using a separate tank of gaseous fuel for pilot flame 19 and or burner 18, it is possible that upon the initial lighting of pilot flame 19 and or burner 18, the liquid-phase fuel passing through the vaporizer 2 will not reach the temperature that will cause some, if any at all, of the liquid-phase fuel to vaporize to a gas because the temperature of the water-glycol mixture, heating passage 40 etc. are all at an ambient temperature that is less than that required to vaporize the liquid-phase fuel. As mentioned above, reducer 190 will reduce the amount of any liquid-phase fuel passing through the reducer 190 and this will help vaporize it before it reaches the regulator 16. The amount of gaseous fuel required for torches 4 is much greater than that of burner 18 and pilot flame 19 thus reducing the volume of such flowing toward burner 18 and pilot flame 19 will not have a negative effect on the functioning of torches 4. It is also contemplated that a hose with a different inner diameter than that of hose 14 could be used to achieve similar results.

Figure 3:
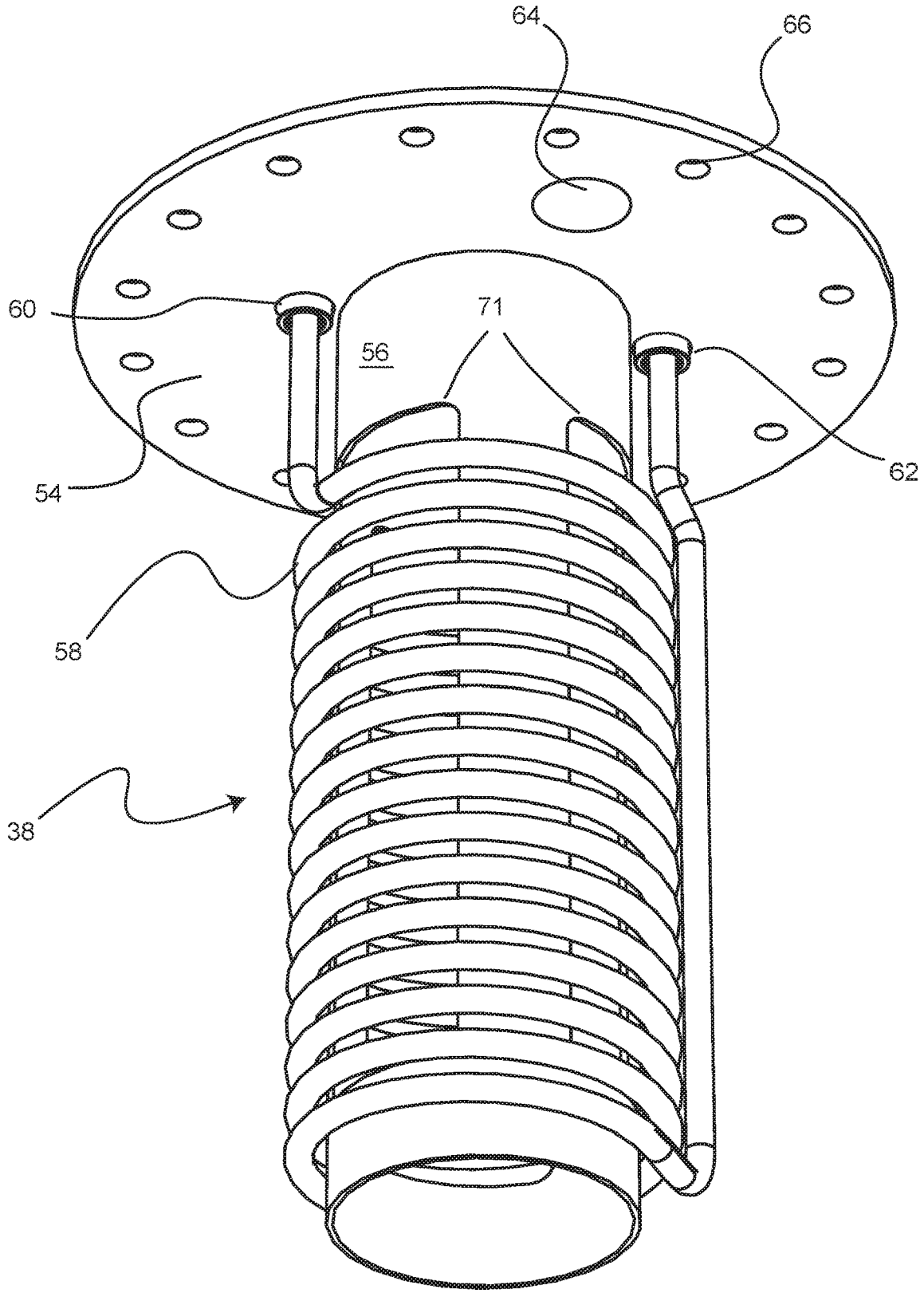
FIG. 3 is a perspective view of the heating core of the vaporizer of the present implementation.

With reference to FIGS. 2 and 3, a heating core 38 is show within the reservoir 30. Heating core 38 is fluidly connected to the tank 26 to receive the liquid-phase fuel therein. With reference to FIG. 3, heating core 38 has been shown in isolation. To removably connect heating core 38 to reservoir 30, heating core 38 includes a flange 54 having several apertures 66 passing therethrough. Best shown in FIG. 2, apertures 66 in flange 54 align with apertures 37 in reservoir flange 36 to connect heating core 38 to the reservoir 30 and seal the water-glycol mixture within the reservoir 30. A seal 70 is placed between flanges 36 and 54 to ensure a liquid tight connection. In the present implementation, heating core 38 is removable from reservoir 30 in the event heating tube 58 requires inspection and or maintenance.

Heating core 38 further includes an inner core 56 extending from flange 54 which provides support for the spiral-shaped heating tube 58. Inner core 56 includes several apertures 71 such that the water glycol mixture 32 can easily flow around the heating core 38. In the present implementation, inner core 56 is hollow and cylindrical in cross section, it is contemplated that the inner core 56 could be any suitable cross section or even omitted in the case heating tube 58 does not need supporting.

Heating tube 58 is constructed of a thin-walled tube, preferably of a material which efficiently allows the heat from the water-glycol mixture to pass therethrough into the liquid-phase fuel passing within. Metals such as steel and aluminum are suitable, but others are contemplated.

Heating tube 58 has a first inlet end 60 passing through flange 54 through which the liquid-phase fuel enters the heating tube 58. Heating tube 58 extends into reservoir 30 by spiraling around the inner core 56 then returns toward flange 54 to an outlet end 62 through flange 54. The length of heating tube 58 will be determined by the heat transfer necessary for the liquid-phase fuel to be vaporized into a gaseous fuel. A person skilled in the art would recognize that the rating of the burner, the heating passage shape and material, the heating liquid, and the size and shape of the heating tube will all influence the amount of liquid-phase fuel which can be effectively vaporized through vaporizer 2. Such a person skilled in the art would recognize which materials to use and in which portions in order to obtain desired results with respect to the exterior ambient temperature.

Best seen in FIG. 2, heating core flange 54 is fixed to flange 36 via several fasteners 68 such that the liquid-phase fuel inlet 60 is extending outside the reservoir 30 to be connected to tank 26 via the hose 24 and regulator 28. Gaseous fuel outlet 60 is also shown extending outside reservoir 30 connecting to splitter 8 via hose 22. It is contemplated that hoses 22 and 24 could be replaced with a manifold connected directly to flange 54 and hoses 6 and 14.

To determine the level of the water-glycol within reservoir 30, a liquid level sight glass 72 is placed within an upper portion of the reservoir 30. To fill or remove the water-glycol mixture from the reservoir 30, a cap 74 is inserted into aperture 64, best shown in FIG. 3, which is used to fill the reservoir 30.

A second security valve 76 is sealing inserted through the wall of the reservoir 30. Security valve 76 is calibrated to open when the pressure or temperature within reservoir 30 exceeds predetermined amounts. In the present implementation, valve 76 is set to open at a pressure of 5 psi or a water-glycol temperature of 210 degrees Fahrenheit.

To visually see the temperature of the water-glycol mixture 32 while using the vaporizer 2, a dial-type temperature gauge 78 is installed to reservoir 30. The temperature gauge 78 has a probe 80 that extends within the reservoir 30 and in contact with the water-glycol mixture 32. In the present implementation, probe 80 passes through an opening (not shown) within flange 54 and is sealed such that no liquids will escape. It is contemplated that temperature gauge 78 could be installed elsewhere on reservoir 30. It is also contemplated that a digital gauge could be used thus probe 80 and the digital gauge could be provided at different places for convenience.

Burner 18 is equipped with a dial 86 which allows the user to determine at what temperature the water-glycol mixture 32 is to be maintained. A temperature sensor 84 is connected to the burner 18 so that the temperature of the water-glycol mixture 32 is supplied to the burner 18.

As mentioned above, the pressure of a liquid-phase fuel or a gaseous fuel within a tank such as tank 26, will depend on the ambient temperature surrounding the tank. As the ambient temperature drops, so does the pressure of the fuel within the tank. If the ambient temperature surrounding tank 26 drops below a predetermined temperature, the pressure of the liquid-phase fuel will not be enough to operate torches 4 once the liquid-phase fuel has been vaporized by the vaporizer 2. At or below this temperature, a heating element 89 is placed around the tank 26 to increase the temperature surrounding the tank 26 thus maintain a certain pressure within the tank 26. In the present implementation, a minimum of 45 PSI to 65 PSI is desired for the torches 4 to function properly.

Heating element 89 is shown as an electric tank heater such as a Powerblanket® GCW420. It is contemplated that any suitable tank heater could be used which includes electric or otherwise.

Figure 4:
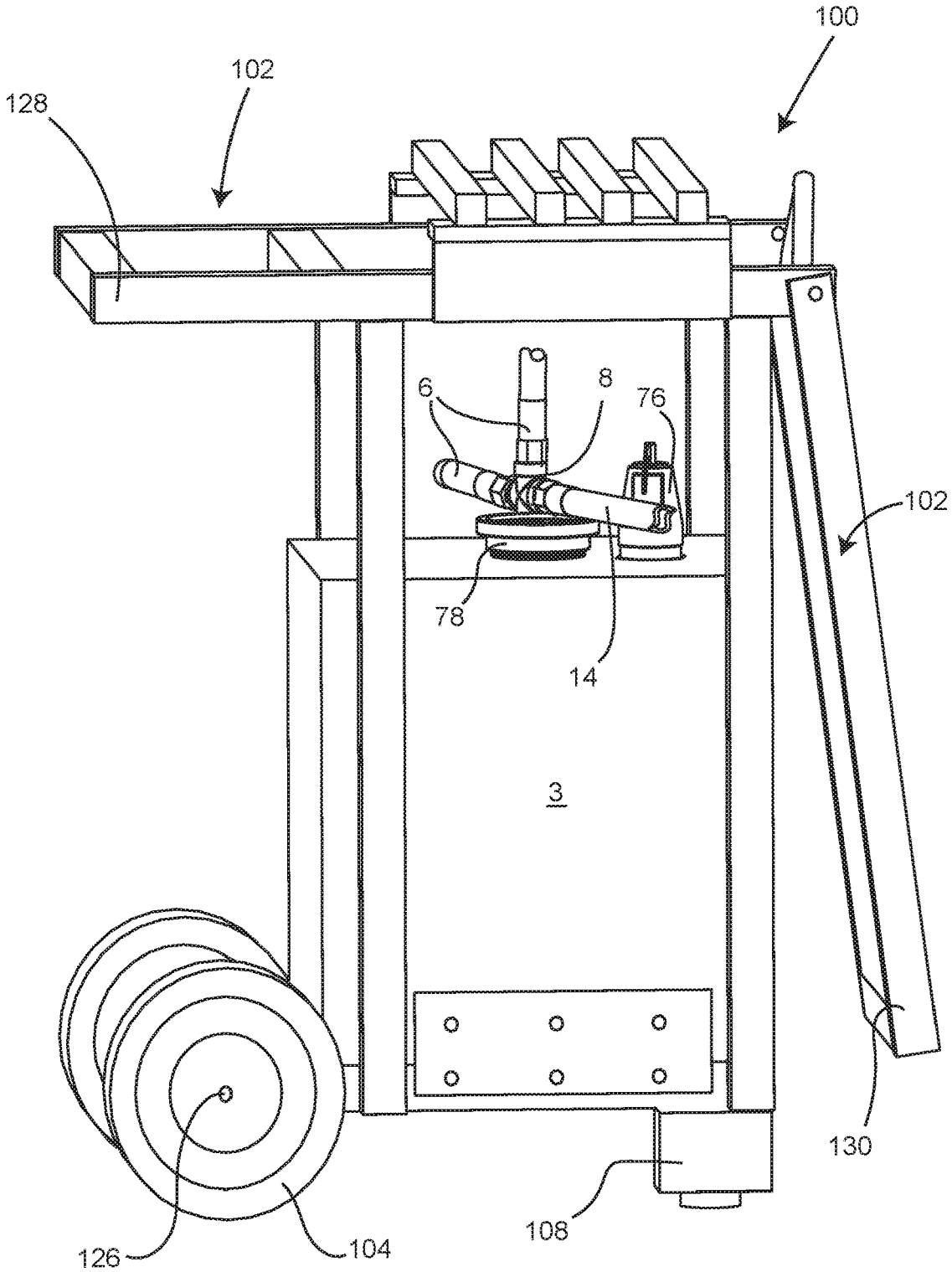
FIG. 4 is a view from the right rear side of a second implementation of the liquid fuel vaporizer.

FIGS. 4 to 7 illustrate a second implementation of a vaporizer 100. Elements of the vaporizer 100 that are similar to those of the vaporizer 2 retain the same reference numerals. With reference to FIG. 4, vaporizer 100 includes an exterior frame 102 comprised of metallic tubing which provides additional protection to the vaporizer 100 as it is being transported around a construction site or from one site to another. To help in transporting the vaporizer 100, a set of wheels 104 are been mounted to the frame 102. To transport the vaporizer 100, it is contemplated that a user will tilt the vaporizer 100 about the axis of wheels 126 using a handle 128 formed with frame 102 until the vaporizer is balanced on the wheels 104 and can be pushed or pulled in a forward or backward direction. Frame 102 surrounds and connects to the protective housing 3 of the vaporizer 100. One or more legs 108 are placed along frame 102 in front of the wheels 104 such that once in contact with the ground, the vaporizer is substantially parallel with the ground. Frame 102 further comprises a pivotable front portion 130. Front frame portion 130 can be pivoted to be parallel with the ground to be used as a work bench or the like. Also seen in FIG. 4 is hose 14 which serves to connect the burner 18 to the splitter 8.

Figure 5:
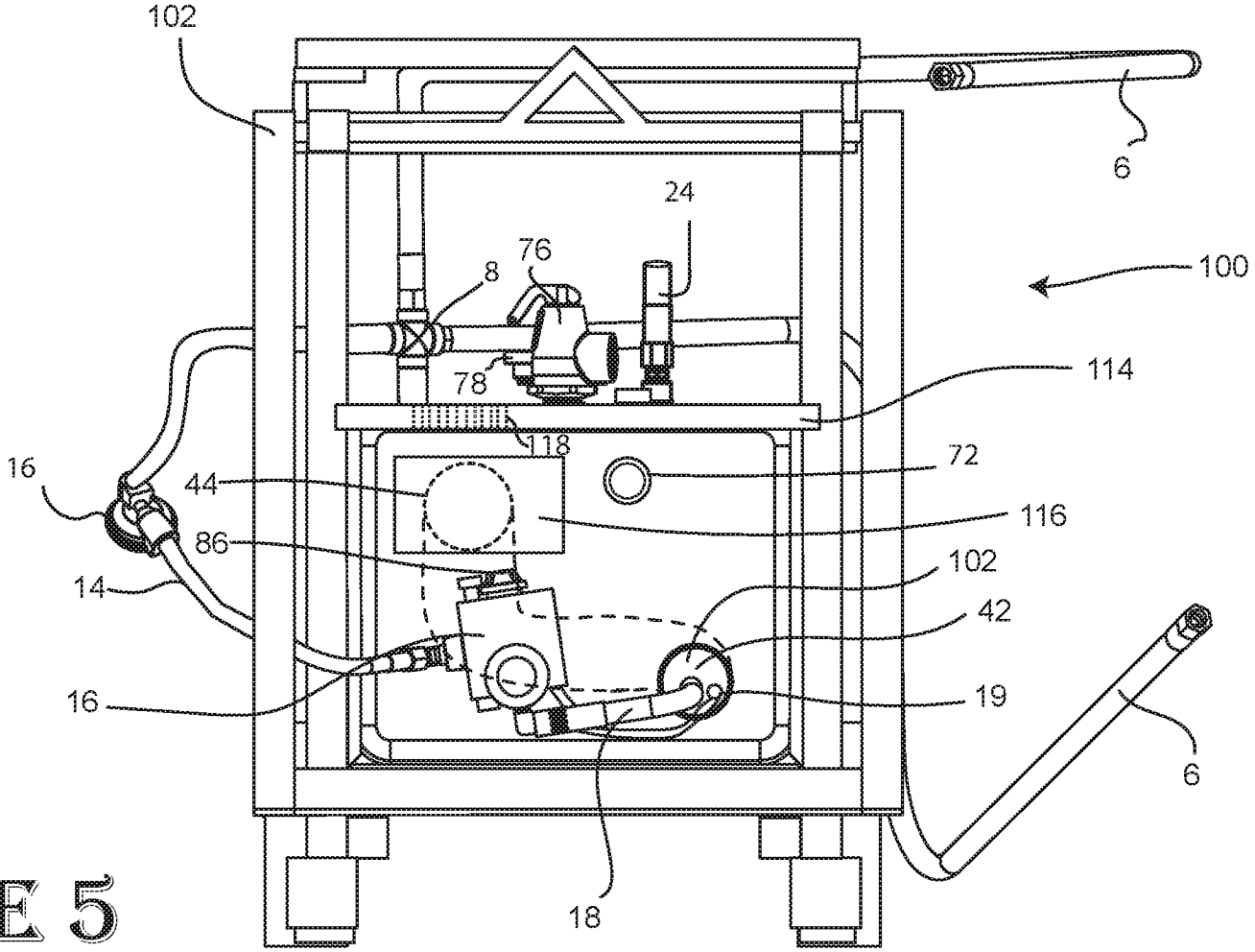
FIG. 5 is a front view of the vaporizer of the second implementation with a control panel cover in an open position.
Figure 6:
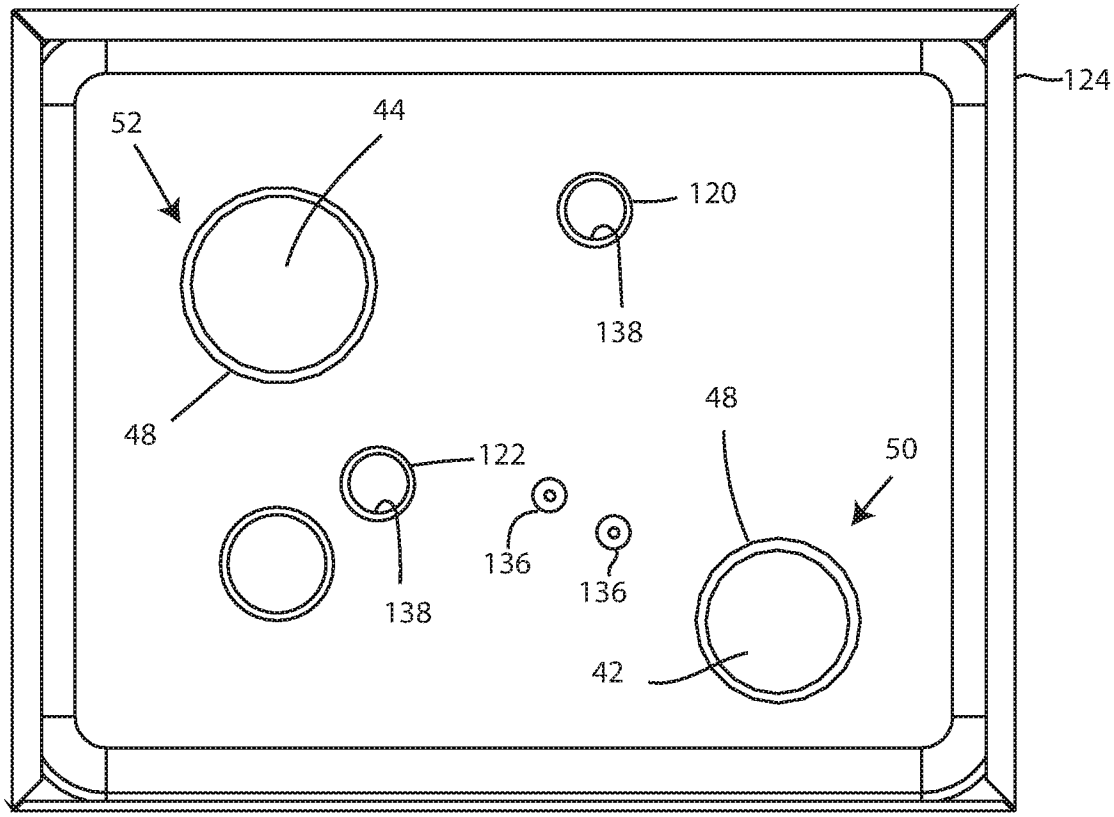
FIG. 6 is a front view of a connection plate of the vaporizer of the second implementation.

Turning now to FIGS. 5 and 6, vaporizer 100 is shown with an access cover 114 in an opened position to access dial 86 which controls flame 20 of the burner 18. Security valve 76 and regulator 16 are also found under access cover 114. Best shown in FIG. 6, heating passage 40 extends through mounting plate 124 such that openings 42 and 44 are directed toward cover 114. Mounting plate 124 supports a heat deflector 116 shown in FIG. 5. Mounting plate 124 is fixed to the reservoir 30 using one or more rivets 136 or other suitable methods of attachment and will be described in more detail below. Heat deflector 116 is connected to the mounting plate 124 such that heat is deflected away from the regulator 16 and dial 86 toward holes 118 in access cover 114 to direct the flow of exhaust from the burner 18 to the atmosphere.

Figure 7:
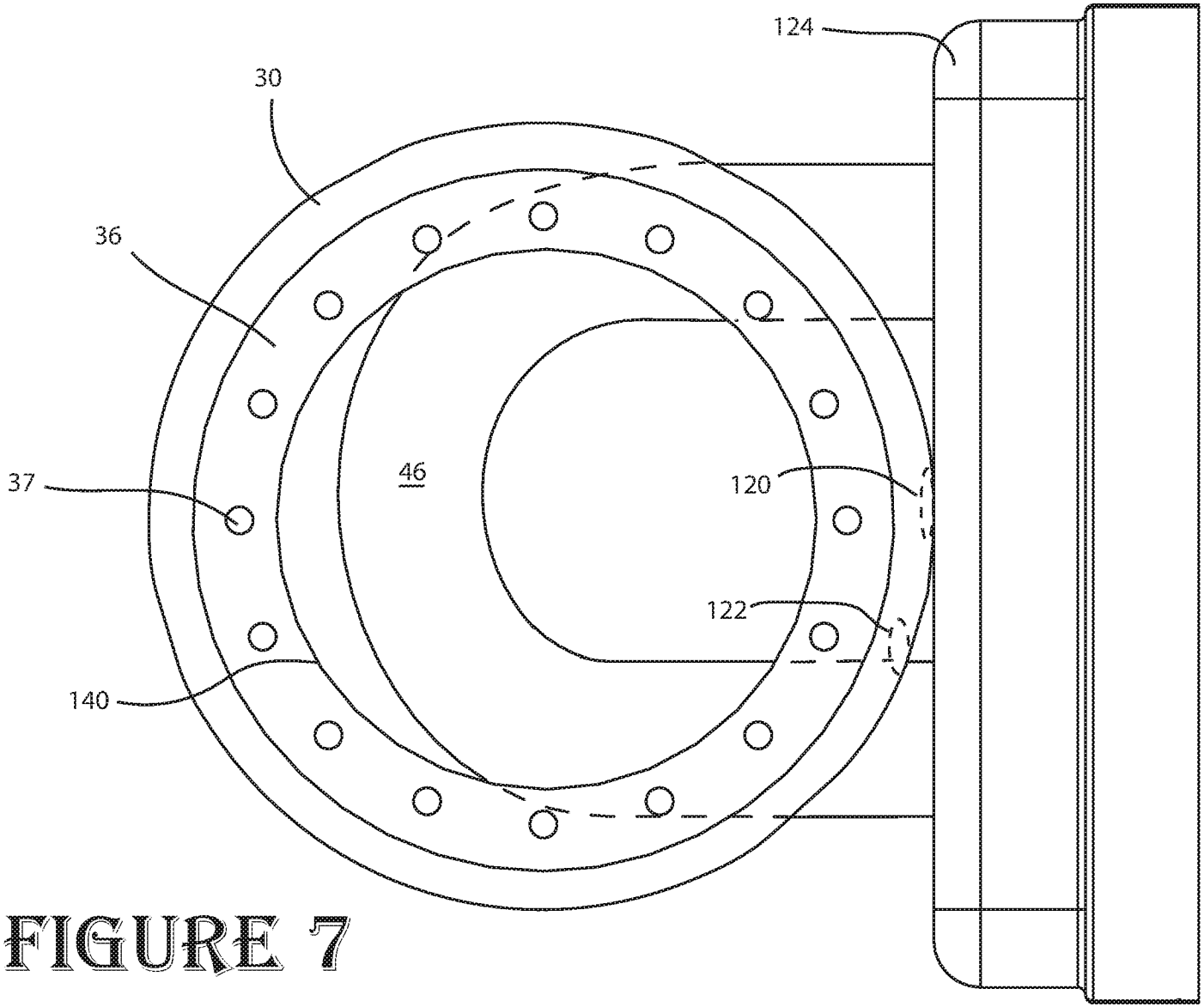
FIG. 7 is a top plan view of a reservoir and connection plate in isolation with the heating core removed from the reservoir of the second implementation.

Also shown in FIG. 6 is fitting 122 for the temperature sensor 84. Fitting 122 extends through an opening in the mounting plate 124 of the reservoir 30. The openings in the reservoir 30 through which the fittings 120 and 122 extend will be sealed with an adhesive, welding or other suitable means to prevent the water-glycol mixture from leaking around the fittings and from the reservoir 30. With reference to FIG. 7, fitting 122 can been seen passing through the wall of the reservoir 30 to open inside reservoir 30. Best seen in FIG. 6, fitting 122 includes threads 138 into which the temperature sensor 84 is threaded to create a liquid-tight fitting.

With respect to FIG. 7, reservoir 30 and mounting plate 124 are shown in isolation. Heating core 38 as shown in FIGS. 2 and 3 have been removed from the reservoir 30 for illustrative purposes. Flange 36 surrounds opening 140 in reservoir 30 through which heating core 38 will pass and be fixed thereto. As mentioned above with vaporizer 2, flange 54 of the heating core 38 is bolted to flange 36 using several fasteners 68 passing through apertures 37 in flanges 36 and 54. A suitable seal can be provided between flanges 36 and 54 to obtain a liquid-tight connection.

Heating passage 40 is seen extending into reservoir 30 in a u-shaped structure which will partially surround the heating core 38 once installed into the reservoir 30. As described above with respect to vaporizer 2, surface 46 of the heating passage 40 will be in contact with the water-glycol mixture that will fill reservoir 30 during operation. The thin-walled structure of the heating passage 40 allows an efficient heat transfer from the flame 20 to the water-glycol mixture such as to transfer the heat to the heating tube 58 thus to the liquid-phase fuel therein.

Modifications and improvements to the above-described implementations of the present may become apparent to those skilled in the art. The foregoing description is intended to be exemplary rather than limiting. The scope of the present is therefore intended to be limited solely by the scope of the appended claims.

What is claimed is:

1. A portable vaporizer for heating a liquid phase fuel, the portable vaporizer comprising:

a reservoir having at least one wall for containing a liquid;

a heat-conducting fluid within the reservoir;

a heating core, the heating core extending into the reservoir in the shape of a cylinder having a plurality of spirals such that the heating core is in fluid contact with the heat-conducting fluid, the heating core having an inlet through which the liquid phase fuel will flow and an outlet through which vaporized liquid phase fuel will flow;

a heating passage, the heating passage being a u-shaped hollow tube having at least one open end and at least partially surrounding the heating core, the heating passage extending at least partially within the reservoir such that at least a portion of an exterior surface of the heating passage is in fluid contact with the heat-conducting fluid;

a heat source, the heat source communicating with the at least one open end of the heating passage to heat the heating passage and the heat conducting fluid surrounding the heating passage to vaporize the liquid phase fuel within the heating core;

a first pressure regulator; the first pressure regulator fluidly connected upstream of the inlet of the heating core such that the liquid phase fuel will undergo a first pressure drop before entering the heating core, the first pressure drop being within a high pressure range;

a second pressure regulator, the second pressure regular fluidly connected downstream from the outlet of the heating core and upstream of the heat source such that the vaporized liquid phase fuel will undergo a second pressure drop before entering the heat source source, the second pressure drop being within a low pressure range; and at least one handle, the at least one handle allowing a single user to transport the portable vaporizer.

2. The portable vaporizer of claim 1 wherein the heat source is a burner producing a flame, wherein the flame is directed into the heating passage to directly heat the heating passage.

3. The portable vaporizer of claim 2 wherein the at least one open end is a first opening, the heating passage further comprising a first end having the first opening, the flame being directed into the first opening of the heating passage.

4. The portable vaporizer of claim 3, wherein the burner is placed adjacent the first opening of the heating passage such that the flame is completely surrounded by heating passage.

5. The portable vaporizer of claim 4, further comprising an outer protective housing having at least one planar surface;

the heating passage further comprises a second end having a second opening, the second opening passing through the reservoir, wherein the first and second openings pass through the at least one planar surface of the outer protective housing such that exhaust created by the flame is exhausted to the atmosphere.

6. The portable vaporizer of claim 5, wherein the inlet of the heating core is fluidly connected to a liquid phase fuel source and the outlet of the heating core is fluidly connected to a utility tool.

7. The portable vaporizer of claim 6, wherein the heating core further comprises a flange connected to the reservoir, and wherein the inlet and outlet of the heating core are connected to the flange such that the liquid phase fuel passes through the flange into the heating core.

8. The portable vaporizer of claim 7, where the heating core flange further comprises an aperture through which the heat-conducting fluid is poured into the reservoir.

9. The portable vaporizer of claim 8, further comprising a first hose, the first hose having a first end fluidly connected to the outlet of the heating core and a second end connected to the burner.

10. The portable vaporizer of claim 9, further comprising a second hose, the second hose having a first end connected to the outlet of the heating core and a second end connected to the utility tool.

11. The portable vaporizer of claim 10, further comprising a splitter, the splitter having at least one inlet and at least two outlets, the at least one inlet fluidly connected to the outlet of the heating core and a first one of the at least two outlets fluidly connected to the burner and a second one of the at least two outlets connected to the utility tool.

12. The portable vaporizer of claim 11, wherein the heating core is removably fixed to the reservoir.

13. The portable vaporizer of claim 7, further comprising:

a top side;

a bottom side;

a right side;

at least one set of wheels operatively connected adjacent to the portable vaporizer bottom side; and a handle operatively connected adjacent to the portable vaporizer top side; and a portable liquid phase fuel storage container, the portable liquid phase storage container fluidly connected with the inlet of the heating core, wherein the at least one set of wheels and the handle renders the portable vaporizer and the utility tool portable, by a user of the portable vaporizer, from a workplace surface to another workplace surface while using the utility tool, by rolling the portable vaporizer along the workplace surface.

14. The portable vaporizer of claim 13 further comprising a temperature gauge; the temperature gauge having a probe passing though the flange and extending into the reservoir within the spirals of the heating core, and wherein the flange is connected to the top side of the portable vaporizer and wherein the first and second openings of the heating passage pass through the right side of the portable vaporizer.

15. The portable vaporizer of claim 14 further comprising an electric heating element, the electric heating element applying heat to the portable liquid phase storage container upstream from the first pressure regulator to increase the pressure of the liquid phased fuel within the portable liquid phase storage container to at least 40 PSI.

16. The portable vaporizer of claim 7 further comprising a top side, wherein the flange is connected to the top side such that the flange is vertically above a full level of the heat-conducting fluid within the reservoir and the flange can be removed from the reservoir without removing the heat-conducting fluid from the reservoir.

17. The portable vaporizer of claim 1 further comprising a pivotable frame portion, the pivotable frame portion pivoting between a substantially vertical position to a substantially horizontal position to be used as a work bench.

18. The portable vaporizer of claim 1 further comprising an outer protective housing, the outer protective housing surrounding the reservoir; and an insulating material, the insulating material surrounding the reservoir between the outer protective housing and the reservoir.

19. The portable vaporizer of claim 1, wherein the first pressure regulator reduces the pressure to a range of 40 to 100 PSI (pounds per square inch) and the second pressure regular reduces the pressure to 0.5 PSI.

20. The portable vaporizer of claim 3, wherein the heating passage further comprises a second end having a second opening; and the plurality of spirals of the heating core further comprise a lower most spiral and an upper most spiral, the lower most spiral being vertically lower than the upper most spiral, wherein the first and second openings are placed at levels which are vertically between the upper most spiral and the lower most spiral.

* * * * *